US005532806A

United States Patent [19]

Sugita et al.

[11] Patent Number: 5,532,806

[45] Date of Patent: Jul. 2, 1996

[54] IMAGE FIXING APPARATUS HAVING MEANS FOR PREVENTING TEMPERATURE UNEVENNESS

[75] Inventors: Takeshi Sugita; Nobukazu Adachi; Akira Kuroda, all of Yokohama; Manabu Takano, Tokyo, all of Japan

[73] Assignee: Canon Kabushiki Kaisha, Tokyo, Japan

[21] Appl. No.: 234,970

[22] Filed: Apr. 28, 1994

[30] Foreign Application Priority Data

Apr. 28, 1993 [JP] Japan ..... 5-102045
Apr. 28, 1993 [JP] Japan ..... 5-102732

[51] Int. Cl.[6] ..... G03G 15/20

[52] U.S. Cl. ..... 355/285; 355/290

[58] Field of Search ..... 355/285, 289, 355/200, 290; 219/216, 243, 520, 540, 546, 547; 432/59; 118/101, 59

[56] References Cited

U.S. PATENT DOCUMENTS 5,148,226 9/1992 Setoriyama et al. ..... 355/290
5,210,579 5/1993 Setoriyama et al. ..... 355/285
5,345,301 9/1994 Satoh et al. ..... 355/290
5,414,492 5/1995 Kubota ..... 355/200

FOREIGN PATENT DOCUMENTS 63-313182 12/1988 Japan .
2-157878 6/1990 Japan .
4-44075 2/1992 Japan .
4-44076 2/1992 Japan .
4-44077 2/1992 Japan .
4-44078 2/1992 Japan .
4-44079 2/1992 Japan .
4-44080 2/1992 Japan .
4-44081 2/1992 Japan .
4-44082 2/1992 Japan .
4-44083 2/1992 Japan .

*Primary Examiner*—Joan H. Pendegrass
*Assistant Examiner*—Quana Grainger
*Attorney, Agent, or Firm*—Fitzpatrick, Cella, Harper & Scinto

[57] ABSTRACT

An image fixing apparatus includes a heating member; a film in slidable contact with the heating member; a pressing roller cooperable with the heating member to form a nip with the film therebetween; wherein the pressing roller comprises a core metal of aluminum; and a metal member for transferring heat from the heating member.

16 Claims, 9 Drawing Sheets

IMAGE FIXING APPARATUS HAVING MEANS FOR PREVENTING TEMPERATURE UNEVENNESS

FIELD OF THE INVENTION AND RELATED ART

The present invention relates to an image fixing apparatus which heats an image on a recording material, usable with an image forming apparatus such as a printer.

Japanese Laid-Open Patent Application Nos. 313182/1988, 157878/1990, 44075/1992 and so on have proposed as an image heating apparatus for heating an image on a recording material, a structure having a ceramic heater, a film in sliding contact with said ceramic heater and a pressing member for forming a nip with the heater with the film interposed therebetween.

The film type heating apparatus is effective in that a low thermal capacity heater with which the temperature increases quickly and a thin film are usable, so that the power consumption can be saved, and the waiting period can be reduced (quick start).

In a film heating type heating apparatus, a pressing member is usually in the form of a pressing roller. In a tensionless type film heating apparatus as disclosed in Japanese Laid-Open Patent Applications Nos. 44075–44083/1992, the pressing roller is rotated, by which an endless heat resistive film is rotated while being in sliding close contact with the heater surface at the inside surface of the film, thus functioning also as a driving roller.

When a material to be heated is introduced into the nip, the material and the film are nipped between the heater and the pressing roller, and they are together passed through the nip by the rotation of the pressing roller.

In an image fixing apparatus using the film heating type heating apparatus, it is required that the nip has a certain width between the pressing roller (pressing member) and the heater with a heat resistive film therebetween. Therefore, the pressing roller as the pressing member is of a material having enough rigidity against the pressure, more particularly, a steel or stainless steel core metal shaft (central shaft) coated with elastic material layer of soft material such as rubber.

In order to bear against the pressure from the pressing member, the heater is bonded to and supported by a rigid supporting member.

However, in a conventional apparatus, when a recording material (small size sheet) having a width smaller than a maximum width usable with the heating apparatus, is continuously supplied, an ununiform temperature distribution results because the temperature of the pressing member corresponding to the non-sheet area increases more than the sheet area in which the recording material passes.

The similar temperature non-uniformity results also in the heater and the supporting member.

The non-uniformity is called "temperature increase in the non-sheet area".

This temperature increases because the heat is consumed to heat the recording material and the non-fixed toner image in the sheet passing area, whereas in the non-sheet passing area, the heat of the heater is not consumed therefor, although the heat partly flows into the pressing member. The heat is accumulated in the heater, which leads to the temperature increase of the pressing member or the heater.

For example, in the film heating type image fixing device, the pressing member temperature increases up to slightly lower than 300 degrees in the non-sheet area, although the temperature in the sheet area is 130 degrees.

SUMMARY OF THE INVENTION

Accordingly, it is a principal object of the present invention to provide an image fixing apparatus in which the temperature non-uniformity due to the temperature increase in the non-sheet area is prevented.

It is another object of the present invention to provide an image fixing apparatus in which the core material of the pressing roller is of aluminum, and which has a metal member for transferring the heat from the heating material.

It is a further object of the present invention to provide an image fixing apparatus a metal member is provided at a position of 1–6 mm away from the film at an outside portion of the endless film.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
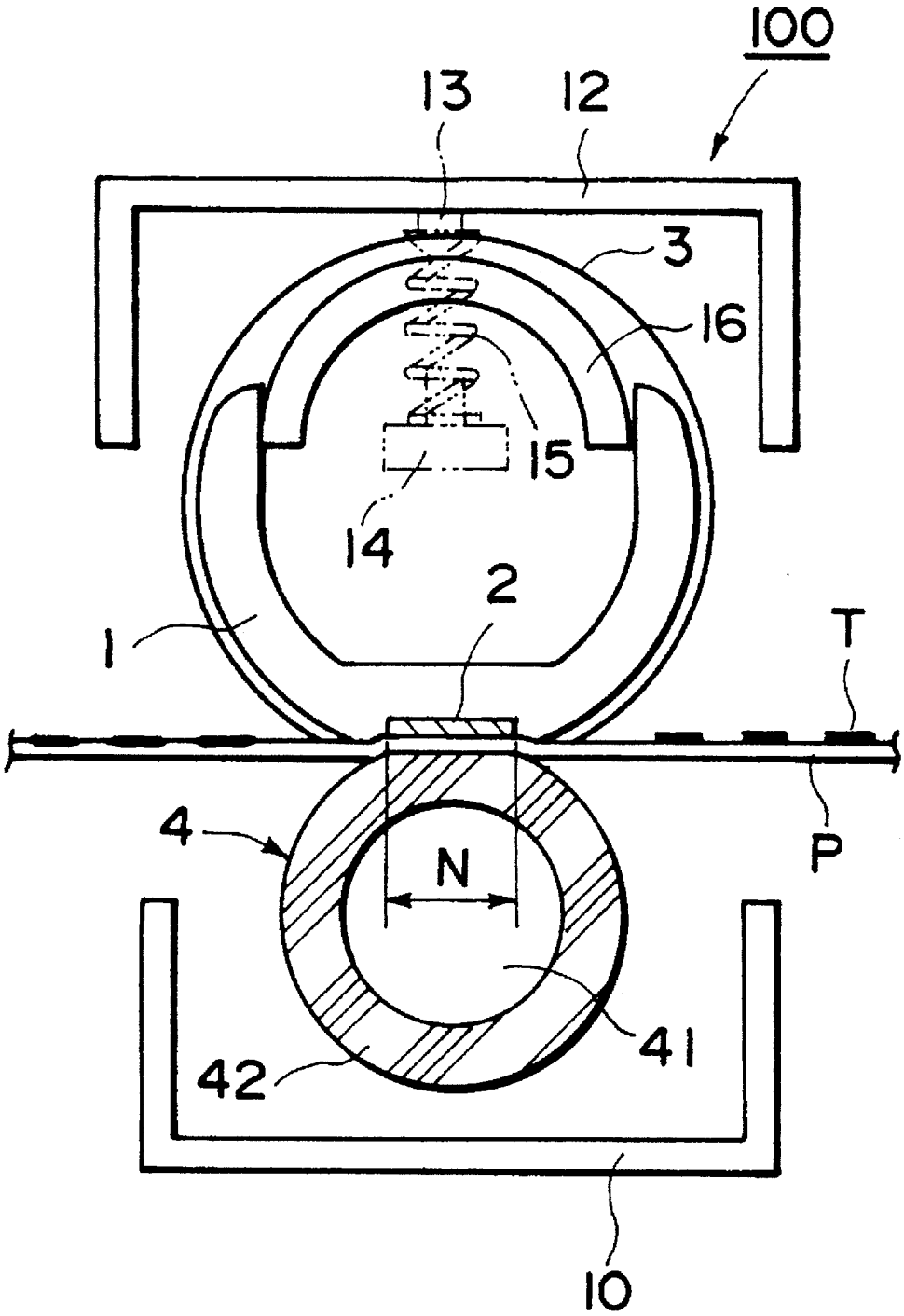
FIG. 1 is a sectional view of an image fixing apparatus according to an embodiment of the present invention.
Figure 2:
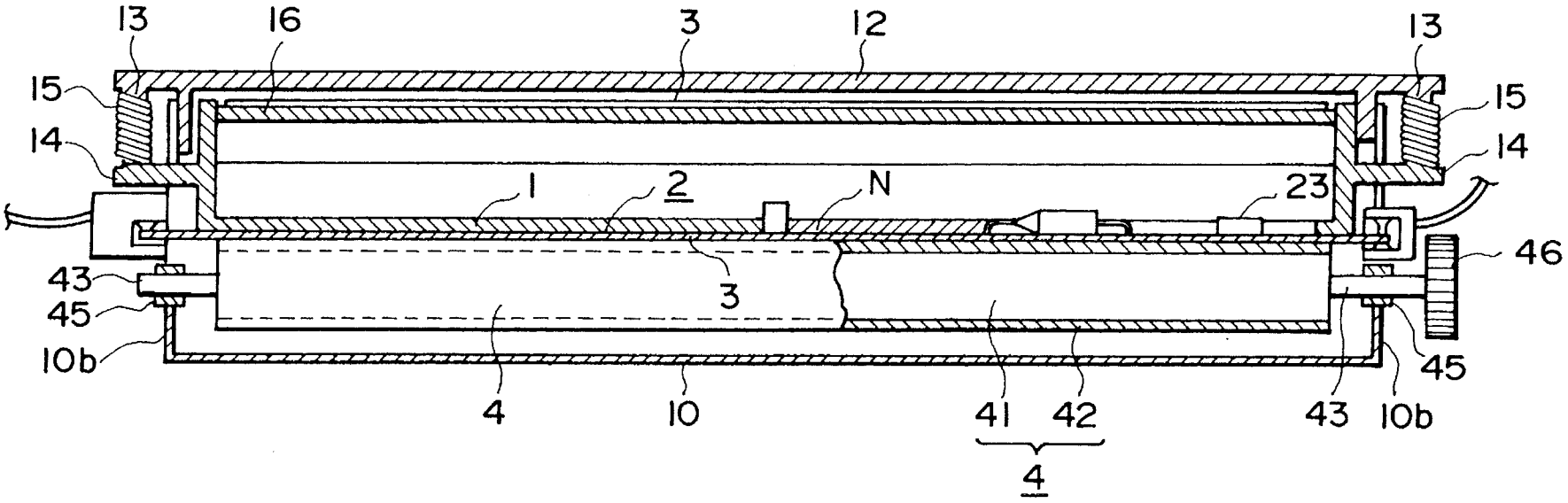
FIG. 2 is a front sectional view of an image fixing apparatus of FIG. 1.

Referring to FIG. 1, there is shown an image heating fixing apparatus 100 according to an embodiment of the present invention as an exemplary heating apparatus of a film heating type. FIG. 2 is a front sectional view of the apparatus.

The image fixing apparatus 100 of this embodiment is of a so-called tensionless type as disclosed in Japanese Laid-Open Patent Applications Nos. 44075–44083/1992.

In FIG. 1, designated by a reference numeral 1 is a heater supporting member of heat resistive and thermal insulation material having a cross-section of semi-circular trough shape. A heater embedding groove is formed along a length of the supporting member 1 in a bottom outer surface substantially at a center. A low thermal capacity linear heater 2 (heater) is fitted in the groove.

A cylindrical heat resistive fixing endless film 3 is loosely extended around the heater supporting member having the heater 2. Therefore, an external outer circumferential of a heater supporting member 1 including the heater 2 and the internal circumferential length of the cylindrical fixing film 3, are such that the length of the film 3 is larger by 3 mm approximately, so that the film 3 is loosely extended around the supporting member 1. In order to maintain the circular shape of the film during the travel of the film, a film inside surface supporting material (cap) 16 is mounted on the upper part of the supporting member.

A pressing roller 4 (pressure-contact roller or back-up roller) is press-contacted to the heater 2 with the film interposed between the pressing roller 2 and the heater.

Referring to FIG. 2, the pressing roller 4 is rotatably supported between end plates 10*b* and 10*b* of a body casing 10 of the apparatus, by way of bearings 45 and 45, at the end portions 43 and 43 of the shaft. A heater supporting member 1 having the heater 2 around which the film 3 is extended, is disposed on the pressing roller 4, and a cover 12 is mounted on the top of the body casing 10 by screws. Between an end lug 13 of the cover 12 and an end lug 14 of the heater supporting member 1, a spring 15 is compressed, at each longitudinal end portion. The compression springs urges the heater supporting member 1 having the heater 2 with the film 3, downwardly, by which the heater 2 and the pressing roller 4 are urged toward each other with the film 3 therebetween, thus forming a fixing nip N. The contact pressure between the heater 2 and the pressing roller 4 is, for example, 3–6 kg in total pressure when the sheet has an A4 width.

A gear 46 fixed to one end of the pressing roller 4 is in meshing engagement with a gear (not shown) of a driving system of a main assembly of the image forming apparatus or the like. It is rotated at a predetermined peripheral speed so that the cylindrical fixing film 3 is rotated by the surface friction with the pressing roller 4 by close contact with the bottom surface of the heater 2.

At this time, the film inside supporting member 16 supports the inside surface of the film, so that the perpendicularity of the film relative to the driving force from the pressing member can be maintained, thus regulating a lateral shifting force in the longitudinal direction.

In this embodiment, the film inside supporting member 16 extends the entirety of the longitudinal length, and the material thereof is aluminum, copper, brass or another high thermal conductivity metal. Thus, the supporting member 16 well conduct the heat from the heater, and therefore, upon the temperature rise in the non-sheet area, the heat easily flows out through the film inside supporting member, thus avoiding the temperature non-uniformity.

During the rotation of the film 3, the recording material P carrying an unfixed toner image T is introduced between the film 3 and the pressing roller 4, and is passed through the nip with the film and in close contact with the film 3, during which the thermal energy from the heater 2 is applied to the recording material P through the film 1, thereby to heat and fix the toner image.

The recording material P, is fed in the same peripheral speed as the fixing film 3 and the pressing roller 4 without sliding, by the contact pressure between the rotating pressing roller 4 and the heater 2, in the fixing nip N. Thus, the passage of the fixing nip N constitutes the heating and pressing step, by which the heat from the heater 2 is transferred onto the recording material P through the fixing film 3, and therefore, an unfixed toner image T on the recording material P is fused and pressed. After passing through the fixing nip N, the fixing film and the recording material P continue to be fed with the close contact therebetween due to the adhesive of the fused or softened toner T. This feeding step functions as a cooling step, in which the heat of the softened or fused toner is radiated, and therefore, the toner T is cooled and solidified into a permanent fixed image on the recording material P. After the cooling step, the fixing film 3 and the recording material P are easily separated from each other due to the cooling and solidification of the toner, by the radius of curvature, and then, the recording material P is discharged from the apparatus.

The temperature control of the heater 2 controls the electric power supply to a heat generating layer (not shown) so that the temperature of the heater 2 detected by a thermister 23 is constant. For example, an output of thermister 23 is A/D-converted, and supplied to a CPU central processing unit (not shown). On the basis of the supplied information, a pulse width modulation such as phase or wave number control or the like to an AC voltage of an AC source for supplying power supply to the heat generating layer, using TRIAC (not shown). Thus, the electric power supply to the heater is controlled. As an alternative, the electric power supply to the heater 2 is rendered on and off by a temperature control system including a thermister 23 and CPU, so that the temperature of the heater is maintained at a proper fixing temperature (170° C., for example).

The heater supporting member 1 is of phenol resin material (heat curing resin material) in which glass is mixed to enhance the rigidity. The thickness from the outer heater-fitting portion to the inside surface is approx. 3.5 mm.

A diameter of a pressing roller 4 is approx. 16 mm, and comprises an aluminum central shaft 41 and a silicone rubber coating layer as an elastic material layer 42.

Figure 3:
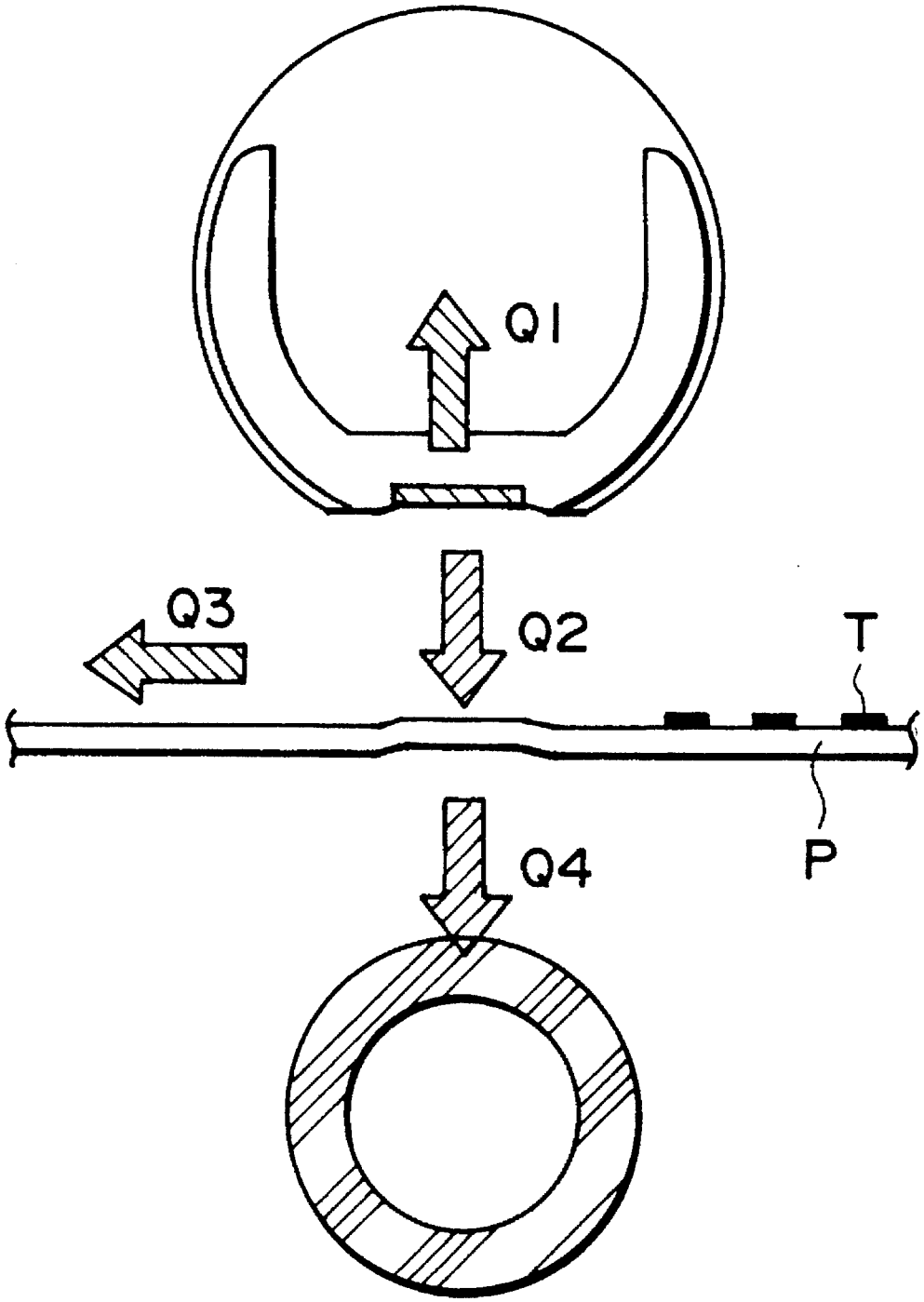
FIG. 3 illustrates flow of heat in the fixing apparatus.

Referring to FIG. 3, the flow of heat in the normal state when a recording material P is supplied to the heating apparatus, will be described.

Heater 2 generates the quantity of heat Q0 per unit time.

A heat quantity Q1 flowing from the heater to the heater supporting member, the heat quantity Q2 flowing from the heater to the nip, a heat quantity Q3 transferred to the sheet, and a heat quantity Q4 flowing to the pressing member, satisfy:

$$Q0=Q1+Q2$$

$$Q2=Q3+A4$$

$$Q0=Q1+Q3+A4$$

When the heat insulating properties of the heater supporting member 1 and the pressing member 4, are high, the heat quantities Q1 and Q4 are small. Assuming that the quantity of heat generation Q0 of the heater is constant, the heat quantity Q3 is large when the heat insulating properties of the heater supporting member and the pressing member are high. Since a part of the heat quantity Q3 is consumed to fuse the toner on the recording material, and therefore, the toner can be fixed with small amount of heat generation.

However, when the heat insulative property of the members around the heater is high, the heat is not easily transferred in the longitudinal direction when a small size sheet is supplied with the result of tendency of temperature rise in the non-sheet-passage area.

Figure 4:
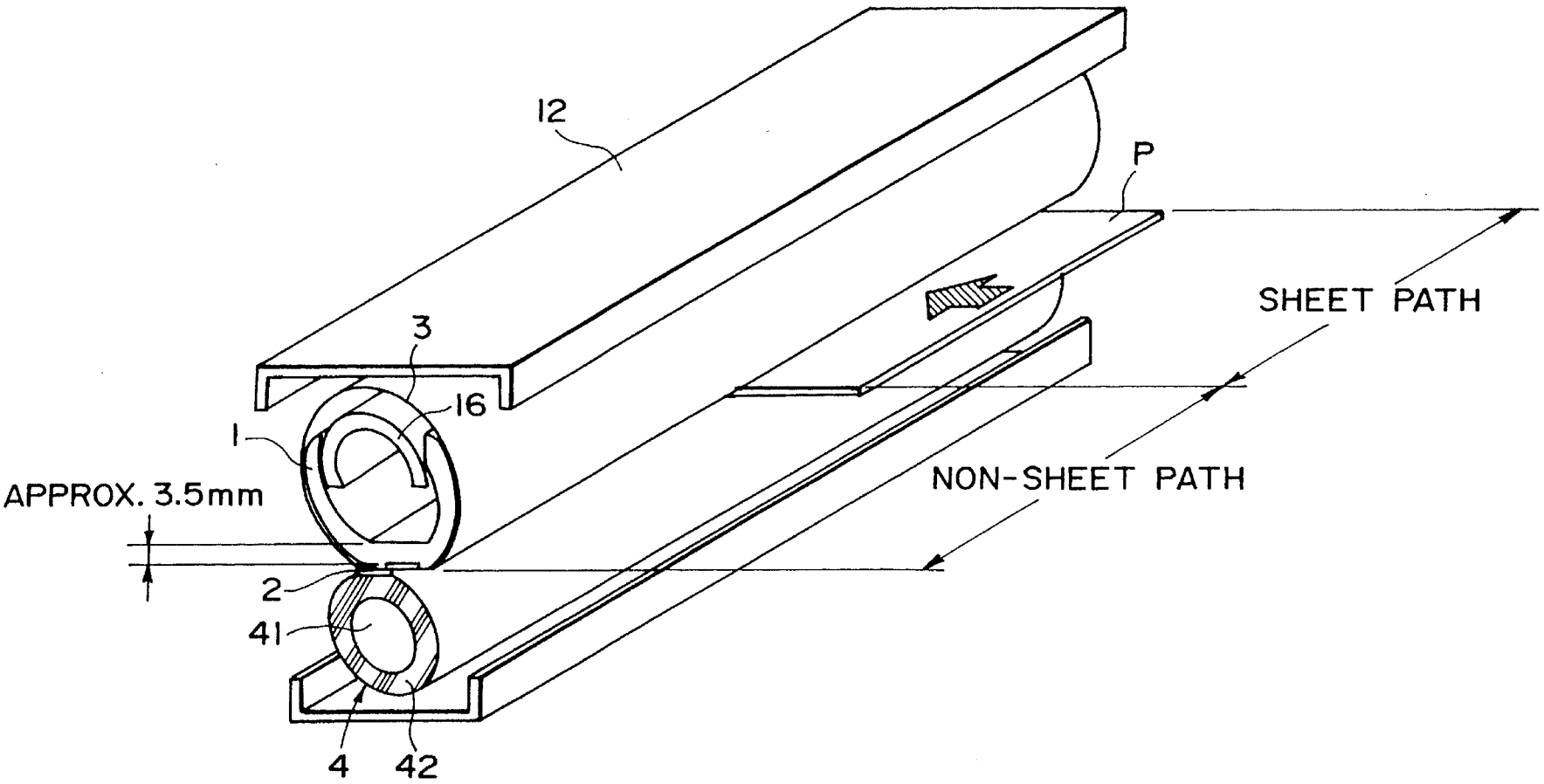
FIG. 4 is a perspective view of an image fixing apparatus of FIG. 1.

Referring to FIG. 4, the flow of the heat of the pressing roller will be described using equations, when a small size sheet is supplied to the fixing apparatus of this embodiment.

Figure 5:
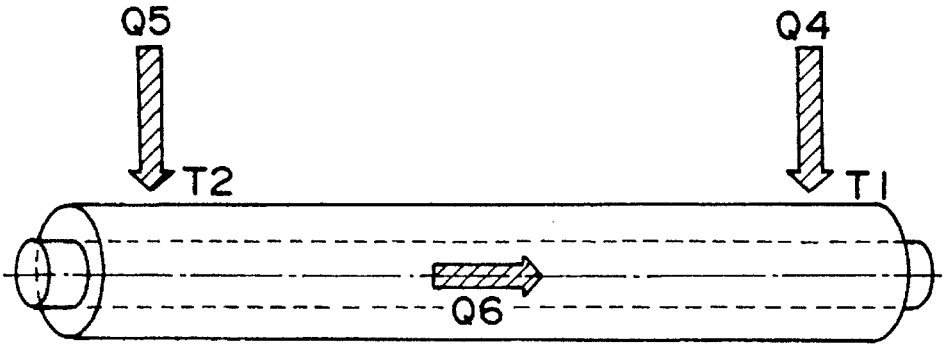
FIG. 5 illustrates flow of the heat in the pressing roller of the fixing apparatus.

FIG. 5 schematically shows the flows of heat in the pressing roller. Designated by Q4 is a quantity of heat per unit time flowing from the heater 2 to the pressing roller 4 in a sheet-passing area; Q5 is a quantity of heat per unit time flowing to the pressing roller 4 in the non-sheet-passage region; and Q6 is a quantity of heat per unit time flowing in an axial direction of the pressing roller; T1 is a temperature of the pressing roller in the sheet-passage region; and T2 is a temperature of the pressing roller in the non-sheet-passage region.

When the pressing roller temperature distribution reaches a stabilized state, after continuous supply of small size sheets, the following equation is satisfied:

$$Q5=Q4+Q6 \quad (1)$$

In addition, the following equation applies:

$$Q6=A\lambda(T2-T1)/L \quad (2)$$

where A is a cross-sectional area of the pressing member 4, λ is a thermal conductivity of the pressing member, and L is a length of the pressing roller.

From equations (1) and (2), $$T2-T1=(L/A\lambda)(Q5-Q4) \quad (3)$$

The thermal conductivity of the pressing member is an equivalent thermal conductivity, that is, a combined thermal conductivity of the elastic material of the pressing member and the central shaft.

When the thermal conductivity of the central shaft increases, the thermal conductivity λ increases in the longitudinal direction.

Assuming that Q5–Q4 is constant, T2–T1 decreases if λ is large.

If the central shaft of the pressing roller is of aluminum, the non-uniformity of temperature due to the temperature rise in the non-sheet-passage region is reduced.

Here, if the thickness of the pressing roller is large, the effect of the aluminum central shaft is reduced. Empirically, it has been confirmed that the ratio of the cross-sectional area of the aluminum core metal to the total cross-sectional area of the pressing roller is not less than 25%, the advantageous effects can be provided.

If the ratio of the rubber layer as the heat insulative layer is too small, the heat radiation through the pressing roller increases, and therefore, the cross-sectional area ratio of the aluminum core metal is preferably not more than 60%.

Thus, in this embodiment, the core metal of the pressing roller is of aluminum, and a supporting member inside the film is of metal, by which the temperature non-uniformity attributable to the temperature rise in the non-sheet-passage area is reduced, thus preventing deterioration of various parts in the fixing apparatus attributable to the heat.

Figure 6:
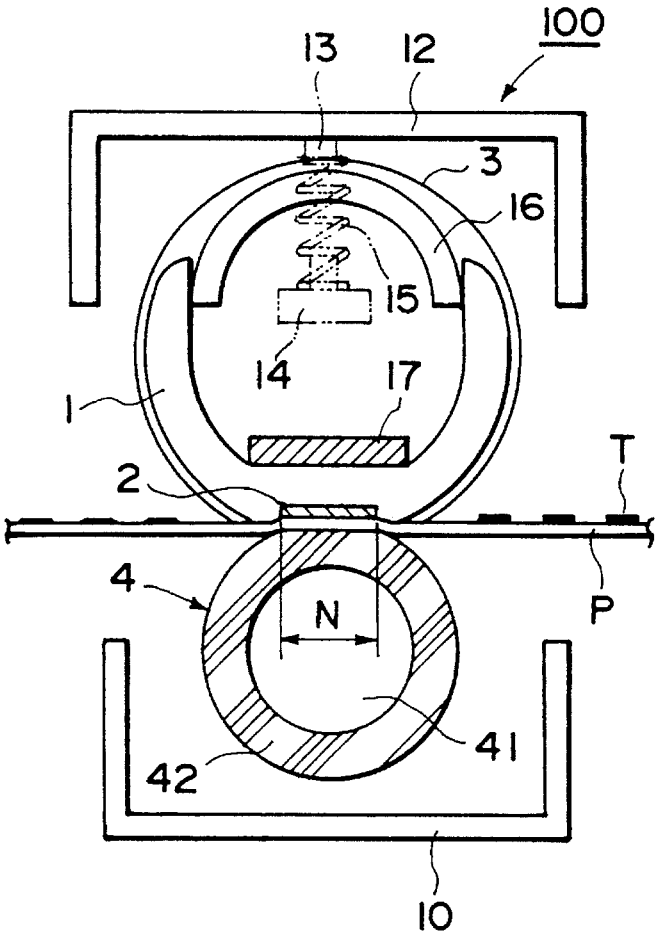
FIG. 6 is a sectional view of an image fixing apparatus according to another embodiment of the present invention.
Figure 7:
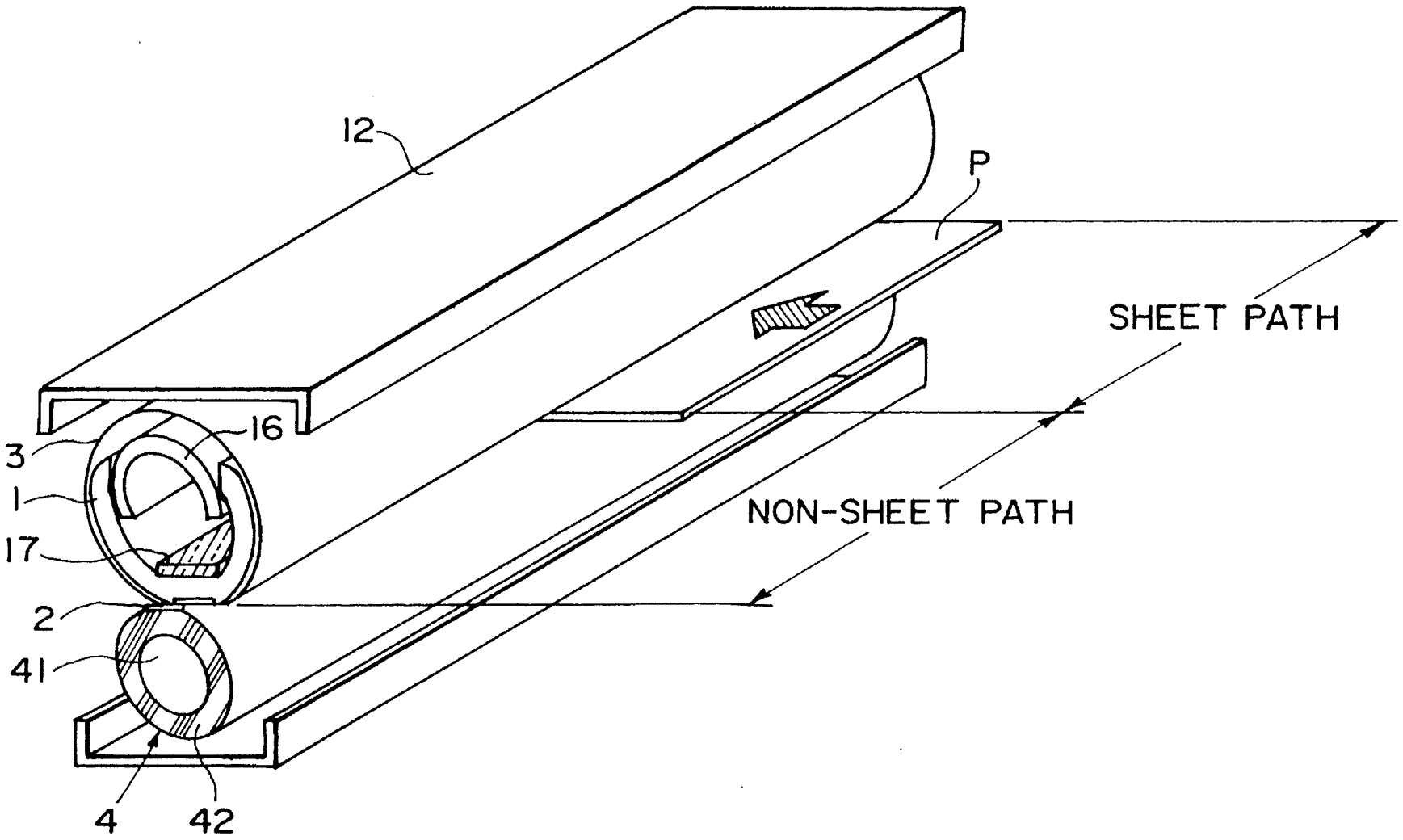
FIG. 7 is a perspective view of an image fixing apparatus of FIG. 6.

Referring to FIGS. 6 and 7, another embodiment will be described.

The structure of the fixing apparatus of this embodiment is fundamentally the same as that of the foregoing embodiment with the following exceptions.

In this embodiment, as shown in FIGS. 6 and 7, a metal sheet 17 having a high thermal conductivity is extended in the longitudinal direction, and is mounted to the heater supporting member on a surface opposite from the heater.

In this embodiment, the heat quantity in the non-sheet passage region flowing to the heater supporting member side upon occurrence of the temperature rise in the non-sheet-passage region, flows to the sheet-passage side through the sheet 17. As a result, the temperature non-uniformity is eased in this embodiment with the result of less deterioration due to the temperature rise of the non-sheet-passage region.

Figure 8:
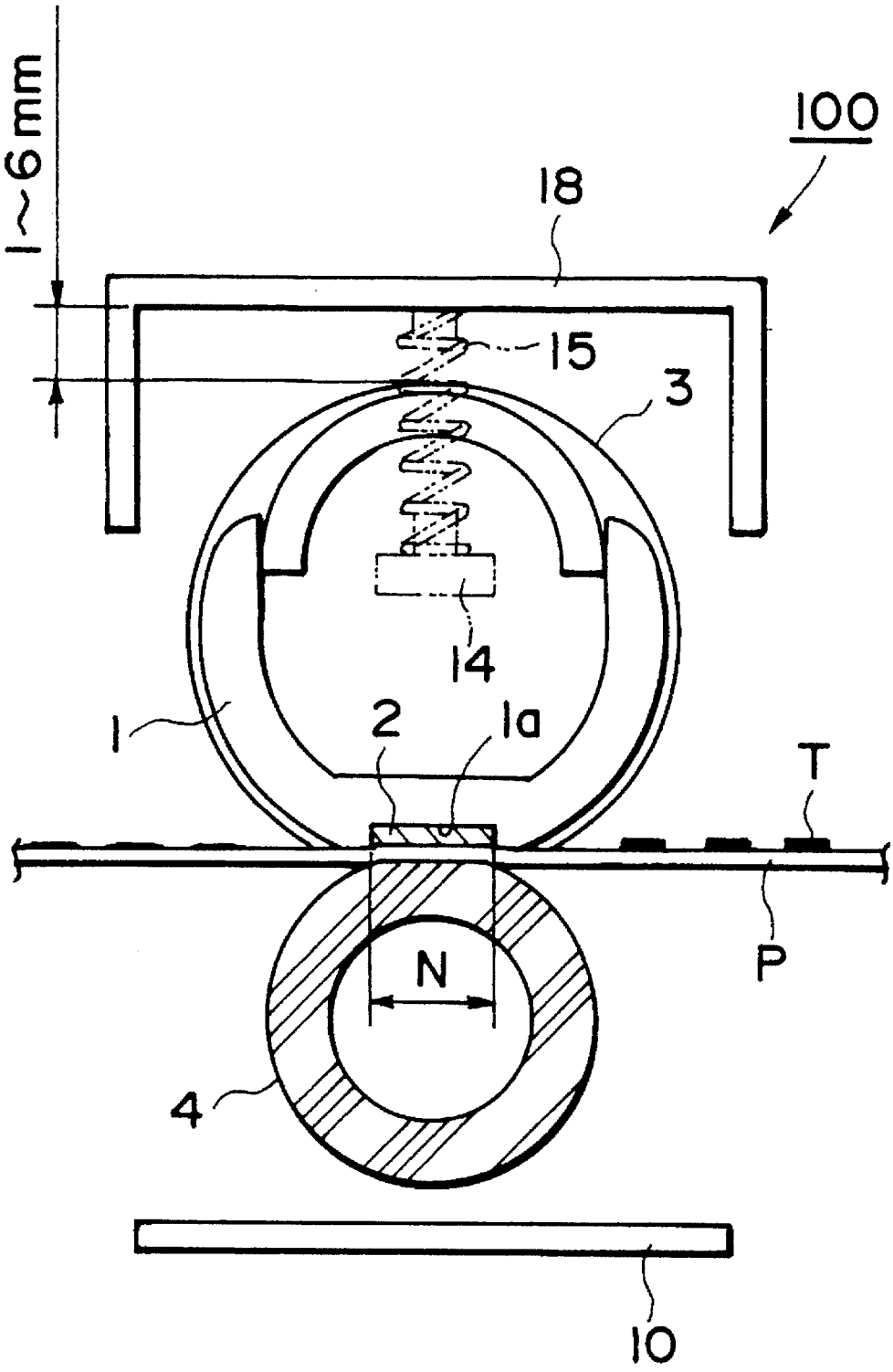
FIG. 8 is a sectional view of an image fixing apparatus according to a further embodiment of the present invention.
Figure 9:
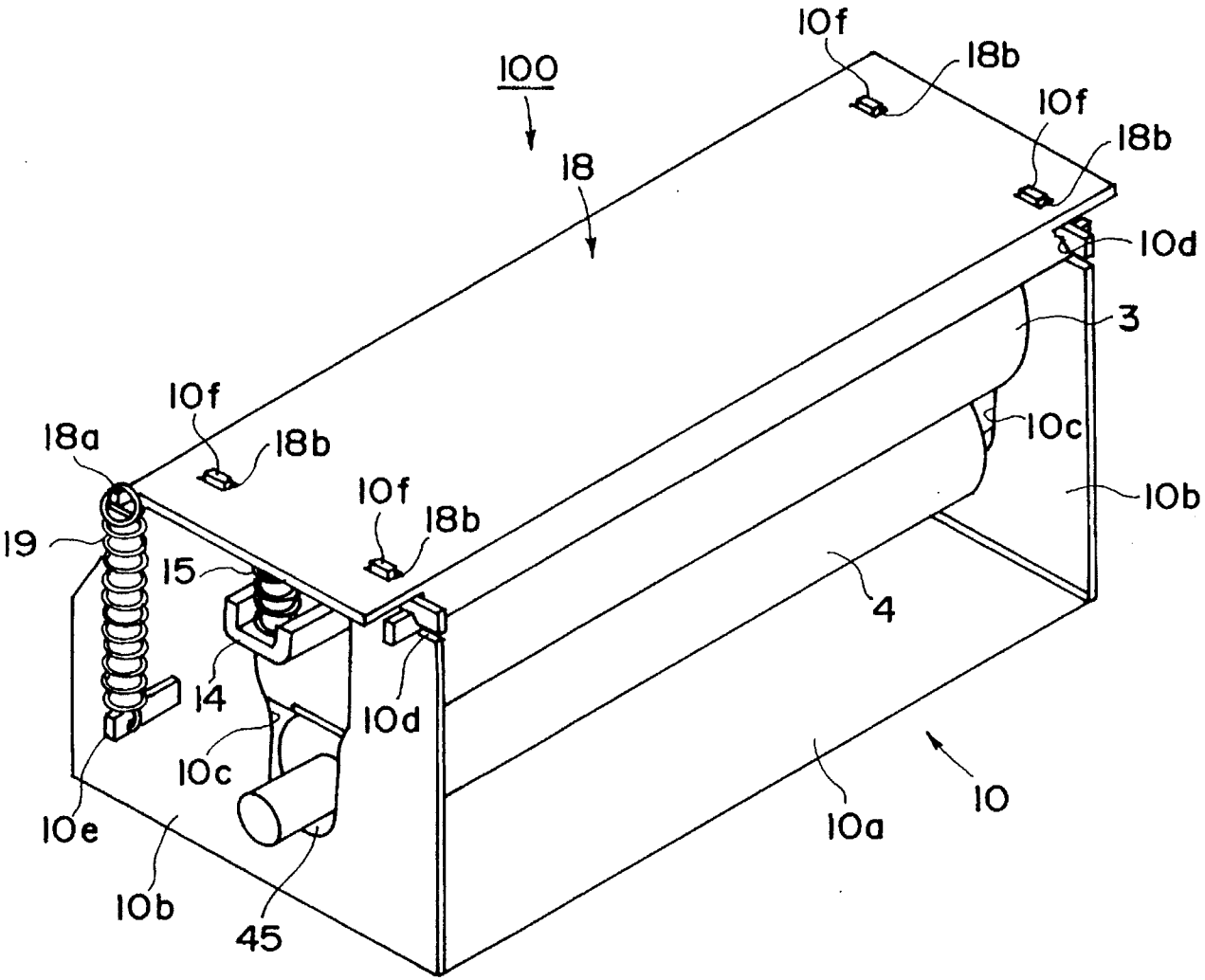
FIG. 9 is a perspective view of an image fixing apparatus of FIG. 8.

Referring to FIGS. 8 and 9, a further embodiment will be described in which a metal member is disposed outside the cylindrical film. FIG. 8 is a sectional view of the fixing apparatus of this embodiment, and FIG. 9 is a perspective view thereof.

In FIG. 8, designated by reference numeral 1 is a film inside guiding member of a heat insulative material having a high heat resistivity and having a semi-spherical cross-section. In a longitudinal direction (perpendicular to the sheet of drawing of FIG. 1) substantially in the center of the bottom surface of the guiding member 1, an embedding groove 1*a* is formed, into which a low thermal capacity linear heater 2 (heater) is fitted.

A cylindrical heat resistive fixing endless film 3 is loosely extended around the film inside guiding member having the heater 2 therein. Therefore, an external outer circumferential of a heater supporting member 1 including the heater 2 and the internal circumferential length of the cylindrical fixing film 3, are such that the length of the film 3 is larger by 3 mm approximately, for example, so that the film 3 is loosely extended around the supporting member 1.

A pressing roller 4 (pressure-contact roller or back-up roller) is press-contacted to the heater 2 with the film interposed between the pressing roller 2 and the heater.

The core material of the pressing roller is aluminum.

In FIG. 9, designated by a reference numeral 10 is a bottom frame of steel plate. The bottom frame 10 is constituted by a bottom 10*a* and side portion 10*b* bent perpendicularly at the opposite ends of the bottom portion 10*a*. The side portion 10*b* is each provided with a slit 10*c* extending substantially vertically, and by the bottom portions of the slits 10*c*, a pressing roller 4 is rotatably supported by way of bearings 45.

On the pressing roller 4, a film inside guiding member 1 with heater 2 (see FIG. 8) and with film 3 are disposed. Projected portions 13 at the opposite ends of the film inside guiding member 1 (see FIG. 8) receive the force of springs 15, so that the film inside guiding member 1 is urged to the pressing roller 4.

An upper part of the pressing spring 15 is confined by an upper frame 18 in the form of a metal member outside the film, and the top frame 18 is rotatably supported in a hole 10*d* of the bottom frame. A tension spring 19 is extended between a portion 10*e* of the bottom frame and a portion 18*a* of the top frame, so that the top frame 18 is positioned correctly (approx. 4 mm above the film 3 in this embodiment), so that the pressure spring 15 can be urged.

The top frame 18 is provided with four positioning holes 18*b*, and by engagement of a projection 10*f* of the bottom frame 10 with the positioning hole 18, by which the positioning in the horizontal direction is effected for the top frame 18. In addition, deformation of the bottom frame 10 can be suppressed. In this embodiment, the top frame 18 is of steel material.

As shown in FIG. 8, a heater 2 and a pressing roller 4 are urged with the film 3 therebetween to form a fixing nip N. The contact pressure between the heater 2 and the pressing roller 4 is 3–6 kg in the total pressure, for A4 size width for example.

A gear 46 fixed to one end of the pressing roller 4 (as shown in FIG. 2) is in meshing engagement with a gear (not shown) of a driving system of a main assembly of the image forming apparatus or the like. It is rotated at a predetermined peripheral speed so that the cylindrical fixing film 3 is rotated by the surface friction with the pressing roller 4 by close contact with the bottom surface of the heater 2.

During the rotation of the film 3, the recording material P carrying an unfixed toner image T is introduced between the film 3 and the pressing roller 4, and is passed through the nip with the film and in close contact with the film 3, during which the thermal energy from the heater 2 is applied to the recording material P through the film 3, thereby to heat and fix the toner image.

The recording material P, is fed in the same peripheral speed as the fixing film 3 and the pressing roller 4 without sliding, by the contact pressure between the rotating pressing roller 4 and the heater 2, in the fixing nip N. Thus, the passage of the fixing nip N constitutes the heating and pressing step, by which the heat from the heater 2 is transferred onto the recording material P through the fixing film 3, and therefore, an unfixed toner image T on the recording material P is fused and pressed. After passing through the fixing nip N, the fixing film and the recording material P continue to be fed with the close contact therebetween due to the adhesive of the fused or softened toner T. This feeding step functions as a cooling step, in which the heat of the softened or fused toner is radiated, and therefore, the toner T is cooled and solidified into a permanent fixed image on the recording material P. After the cooling step, the fixing film 3 and the recording material P are easily separated from each other due to the cooling and solidification of the toner, by the radius of curvature, and then, the recording material P is discharged from the apparatus.

In this embodiment, a distance between the film 3 and the top frame 18 is approx. 4 mm.

The description will be made as to flow of heat when the non-sheet passage region temperature increases.

When a small size sheet passes through the fixing nip, the heater generates heat to fix the toner on the small size sheet. In the region where the sheet passes, most of the generated sheet of the heater 2 is transferred to the small size sheet, whereas in the non-sheet-passage region, all of the heat generated by the heater 2 flows into a pressing roller, film inside guiding member 1 and a film 3 in the fixing device 100.

In this embodiment, the top frame 18 receives the heat from the non-sheet-passage region of the film having a high temperature by radiation and convection, so that the heat flows to the sheet-passing region through the top frame 18, and therefore, the temperature non-uniformity of the film 3 is corrected.

In this embodiment, the temperature of the film 3 is lowered so that the heat easily flows from various members to the film 3, so that the temperature at the non-sheet-passage region in the entirety of the fixing apparatus 100 decreases.

Empirically, it has been confirmed that the above advantageous effect is not quite expected if the distance between the film 3 and the top frame 18 exceeds 6 mm.

On the contrary, if the top frame 18 is too close to the film 3, the heat flows from the film 3 even in the case of the normal size sheet with the result that the temperature in the fixing nip N does not reach the temperature required for the fixing. Empirically, this occurs if the closest distance between the film 3 and the top frame 18 is smaller than 1 mm.

In this embodiment, the distance between the top frame 18 and the film 3 is approx. 4 mm because a sufficient margin can be assured both at the close side and far side.

The aluminum as the material of the top frame 18 is preferable, because the heat flow is better, and therefore, the above described effects are further assured.

Figure 10:
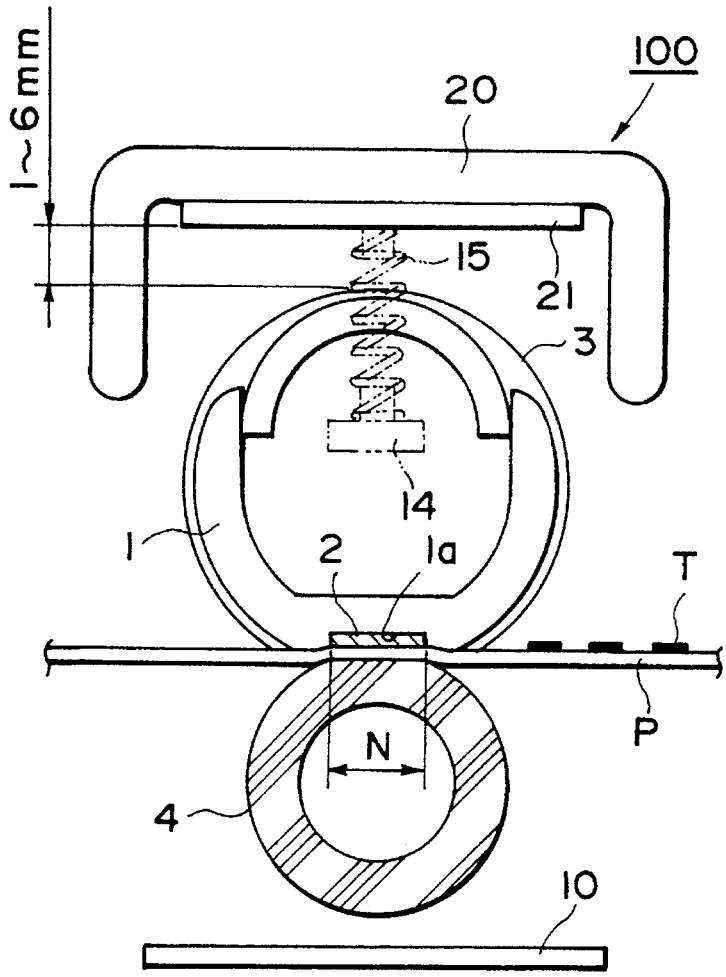
FIG. 10 is a sectional view of an image fixing apparatus according to a further embodiment of the present invention.
Figure 11:
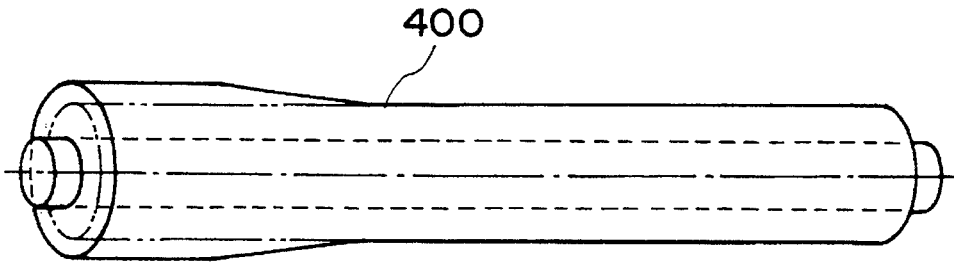
FIG. 11 illustrates a pressing roller deformed by heat.

As shown in FIG. 10, mounting of a metal material 21 in the longitudinal direction to the bottom side of the top frame 20 of molded low thermal conductivity or insulative material, is effective to provide the above advantageous effects.

As described in the foregoing, according to this embodiment, the metal material is provided upside the endless film so that the closest distance from the film is 1–6 mm. Therefore, the temperature rise in the non-sheet passage area can be minimized, and therefore, various problems arising therefrom can be avoided.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heating member;

a film in slidable contact with said heating member;

a pressing roller cooperable with said heating member to form a nip with said film therebetween;

wherein said pressing roller comprises a core metal of aluminum and has a rubber layer outside said core metal and a ratio of cross-sectional area of said core metal to that of said pressing roller is not less than 25%; and a metal member for transferring heat from said heating member.

2. An apparatus according to claim 1, wherein a recording material is passed through and fed by said nip to fix an unfixed image on said recording material by heat from said heating member through said film.

3. An apparatus according to claim 1, wherein said film is an endless film, and said metal member is inside said film.

4. An apparatus according to claim 3, wherein said metal member supports said film.

5. An apparatus according to claim 1, wherein said metal member extends in a direction of width of said film.

6. An apparatus according to claim 1, further comprising supporting member for supporting said heating member, and said metal member is mounted to said supporting member.

7. An image fixing apparatus comprising:

a heating member;

an endless film loop in slidable contact with said heating member;

a pressing roller cooperable with said heating member to form a nip with said film therebetween;

a metal member extending in a direction substantially perpendicular to a movement direction of said film and adjacent to and outside of said film loop, wherein the smallest distance between said film and said metal member is 1–6 mm.

8. An apparatus according to claim 7, wherein said metal member extends in a direction of an axis of said pressing roller.

9. An apparatus according to claim 7, wherein said metal member is a frame of an image fixing apparatus.

10. An apparatus according to claim 7, wherein said metal member is mounted to a frame of said fixing apparatus.

11. An apparatus according to claim 7, wherein a recording material is passed through and fed by said nip to fix an unfixed image on said recording material by heat from said heating member through said film.

12. An image fixing apparatus, comprising:

a heating member;

a film in slidable contact with said heating member; and a pressing roller cooperable with said heating member to form a nip with said film therebetween, wherein said pressing roller comprises a core metal of aluminum and a rubber layer outside said core metal, and a ratio of cross-sectional area of said core metal to that of said pressing roller is not less than 25%.

13. An apparatus according to claim 12, wherein a recording material is passed through and fed by said nip to fix an unfixed image on said recording material by heat from said heating member through said film.

14. An apparatus according to claim 12, further comprising a metal member for transferring heat from said heating member, wherein said metal member is provided each of inside and outside of said film.

15. An apparatus according to claim 12, wherein the cross-sectional area of said core metal relative to that of said pressing-roller is not more than 60%.

16. An apparatus according to claim 1, wherein the cross-sectional area of said core metal relative to that of said pressing-roller is not more than 60%.

* * * * *

UNITED STATES PATENT AND TRADEMARK OFFICE

CERTIFICATE OF CORRECTION

PATENT NO. : 5,532,806
DATED : July 2, 1996
INVENTOR(S) : TAKESHI SUGITA, ET AL.

It is certified that error appears in the above-indentified patent and that said Letters Patent is hereby corrected as shown below:

Column 2,
line 17, "apparatus" should read --apparatus wherein--.
Column 3,
line 27, "springs" should read --spring--; and
line 51, "well" should read --will--.
Column 6,
line 21, circumferential" should read --circumferential length--; and
line 35, "each" should be deleted.

Signed and Sealed this

Tenth Day of November 1998

Bruce Lehman

*Attest:*

BRUCE LEHMAN

*Attesting Officer*

*Commissioner of Patents and Trademarks*